US005085200A

United States Patent [19]

Horton-Corcoran et al.

[11] Patent Number: 5,085,200

[45] Date of Patent: Feb. 4, 1992

[54] SELF-ACTUATING, DRY-FIRE PREVENTION SAFETY DEVICE FOR A CROSSBOW

[75] Inventors: Bernard Horton-Corcoran, Ross-Shire, Scotland; Nicholas Rowlandson, Denbigh Clwyd, Wales

[73] Assignee: Horton Manufacturing Company Inc., Stow, Ohio

[21] Appl. No.: 639,004

[22] Filed: Jan. 9, 1991

[51] Int. Cl.[5] ..... F41B 5/00

[52] U.S. Cl. ..... 124/25; 124/40; 124/35.2

[58] Field of Search ..... 124/23.1, 24.1, 25, 124/25.6, 80, 86, 31, 35.2, 40

[56] References Cited

U.S. PATENT DOCUMENTS

| | | | |
|---|---|---|---|
| 4,030,473 | 6/1977 | Puryear | 124/25 X |
| 4,192,281 | 3/1980 | King | 124/25 |
| 4,479,480 | 10/1984 | Holt | 124/35.1 |
| 4,716,880 | 1/1988 | Adkins | 124/25 |
| 4,877,008 | 10/1089 | Troubridge | 124/25 |

*Primary Examiner*—Randolph A. Reese
*Assistant Examiner*—John A. Ricci
*Attorney, Agent, or Firm*—Renner, Kenner, Greive, Bobak, Taylor & Weber

[57] ABSTRACT

A self-actuating, dry-fire prevention device for a crossbow (10) includes a pivotable stop block (30) and a pivot pin (35) and a spring (41) to pivot said stop block into releasable locking engagement with the crossbow trigger mechanism (15) such that the trigger mechanism is blocked from operating to release the bowstring (43) in the absence of an arrow (40). The stop block (30) has an arrow contacting surface (50, 51) such that when the arrow (40) is placed into position to be fired, the arrow (40) engages the arrow contacting surface (50, 51) causing the stop block (30) to pivot out of locking engagement with the trigger mechanism (15) to allow operation of the trigger mechanism (15) and release of the bowstring (43).

25 Claims, 3 Drawing Sheets

SELF-ACTUATING, DRY-FIRE PREVENTION SAFETY DEVICE FOR A CROSSBOW

TECHNICAL FIELD

The present invention generally relates to a device to prevent the inadvertent dry-firing of a crossbow. More particularly, the present invention relates to a device which will prevent the crossbow trigger mechanism from operatively releasing the bowstring when an arrow is not in place in a position to be fired from the crossbow. Specifically, the invention relates to a self-actuating device which will block at least a portion of the trigger mechanism and prevent it from releasing the bowstring when an arrow is not in place.

BACKGROUND ART

Conventional archery devices usually include a bow having two arms with a bowstring strung between the ends of the arms. The user grasps the bow and "draws" or pulls back on the bowstring with one hand while pushing the bow itself with the other hand. Drawing the bowstring tends to cause the arms to want move toward each other, creating tension therebetween. The amount of force necessary to draw a given bow is usually measured in pounds and is known as the "draw weight" of the bow. When the bowstring is released, energy is transferred through the bowstring and to the arrow which is propelled or "fired" toward a target.

One method of increasing the speed at which an arrow is propelled is to increase the stiffness of the bow arms. However, the user must be able to draw the bowstring. Thus, increasing the stiffness of the bow arms to create a very high draw weight bow may be useless if the user cannot draw it and hold the bow in the drawn position for a sufficient period of time to aim at the target. If the user is struggling with holding the bow string in the drawn position, his aim will be deleteriously affected.

Crossbow technology was developed to relieve the tension applied to the user's arms as encountered when using a conventional bow as discussed hereinabove. The stock of the crossbow holds the bowstring in the drawn position, allowing the user to aim without concern for manually holding and maintaining the draw weight.

Trigger mechanisms, as known in the art, were developed in order to both hold the bow string in the drawn position, and to release the bowstring when the trigger is operated. Often, a bowstring catch is provided which holds the bowstring until the trigger is manipulated, which in turn rotates or otherwise moves a sear, releasing the bowstring catch and hence, the bowstring itself.

With the development of sophisticated trigger mechanisms, improvements such as safety assemblies were also developed. Safety assemblies are known to include a block plate or the like which may be positively manipulated by the user. Manipulating the block plate in one direction causes the block plate to lock the trigger mechanism, such as by engaging and impeding movement of the sear or another portion of the trigger mechanism which is operatively connected to the bowstring catch. When the user is ready to fire the crossbow, the safety assembly is manipulated in an opposite direction, freeing the movement of the relevant portion of the trigger mechanism. It is also known in the art to provide a safety mechanism which will automatically engage into the "safe" or non-firing position when the bowstring is drawn and placed into engagement with the bowstring catch pin.

In both conventional and crossbow art, it is known that drawing and releasing a bowstring without having an arrow in place and in position to be fired, known as a "dry-fire", can not only cause serious damage to the bow but also potential injury to the user. As previously discussed, bows are intended to transfer energy to the arrow when fired. During a dry-fire, most of the energy remains within the bow arms, and the sudden increase in energy which would normally be transferred to the arrow can damage the bow.

Most knowledgeable archers understand the inherent dangers in dry-firing conventional bows and crossbows. However, it is not uncommon with a crossbow to inadvertently cause a dry-fire. Although this has been known to happen in almost any circumstance, hunters often find that when they are distracted by their quarry, the possibility of a dry-fire increases.

Therefore, a need exists for a device which will prevent a crossbow from being dry-fired, and which will automatically engage into the non-firing position when an arrow is not in place and not in a position to be fired.

DISCLOSURE OF THE INVENTION

It is therefore, a primary object of the present invention to provide a device to prevent the inadvertent dry-fire of a crossbow.

It is another object of the invention to provide a device for a crossbow, as above, which will be automatically positioned into the non-firing position when the bowstring is drawn.

It is a further object of the invention to provide a device for a crossbow, as above, which will operate in communication with a crossbow trigger mechanism to prevent dry-firing of the crossbow.

These and other objects of the present invention, as well as the advantages thereof over existing prior art forms, which will become apparent from the description to follow, are accomplished by the means hereinafter described and claimed.

In general, a device for preventing the inadvertent activation of the trigger mechanism of a crossbow without an arrow in place includes a stop block. The stop block has a body member which can engage a portion of the trigger mechanism. In addition, the body member has an arrow contacting surface which, when engaged by an arrow, will move the body member out of engagement with the trigger mechanism.

More specifically, the invention also relates to a crossbow having a bowstring, a trigger mechanism operable to selectively hold and release the bowstring, and a self-actuating, dry-fire prevention device. The dry-fire prevention device has a pivotable stop block and means to pivot the stop block into releasable locking engagement with the trigger mechanism such that the trigger mechanism is blocked from operating to release the bowstring. The stop block has at least one arrow contacting surface such that when an arrow is placed into position to be fired, the arrow engages the arrow contacting surface causing the -top block to pivot out of locking engagement with the trigger mechanism to allow operation of the trigger mechanism and release of the bowstring.

A preferred exemplary dry-fire prevention safety device for a crossbow incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
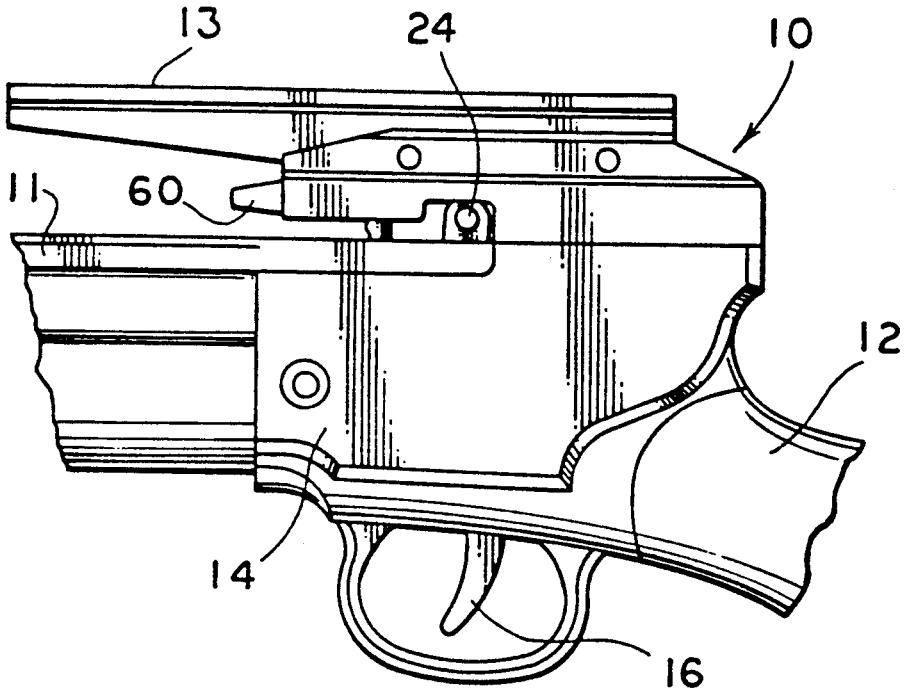
FIG. 1 is a broken away side elevational view of a crossbow shown in the environment of the present invention.

FIG. 1 of the accompanying drawings shows a portion of a relatively conventional crossbow, generally indicated by the numeral 10, and having a fore-stock 11 and a butt-stock 12. A sight bridge 13 is often provided, as is known in the art, as is a trigger mechanism housing 14.

Figure 5:
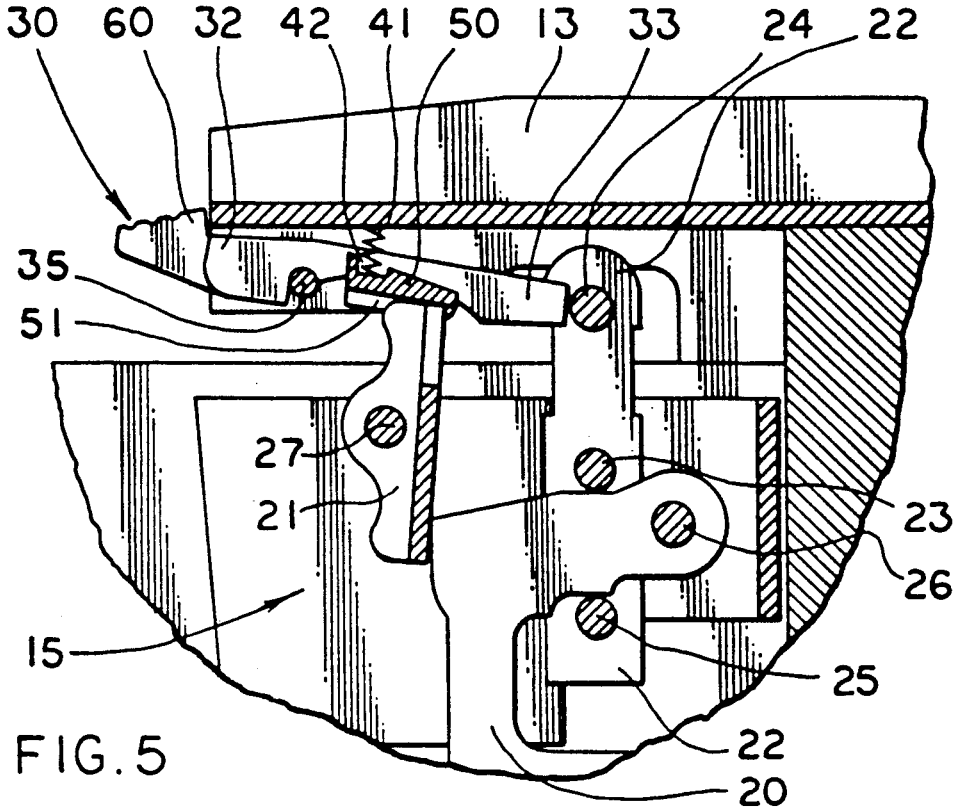
FIG. 5 is a broken away side elevational view of the device of FIG. 4 and showing further details of an exemplary trigger mechanism.
Figure 6:
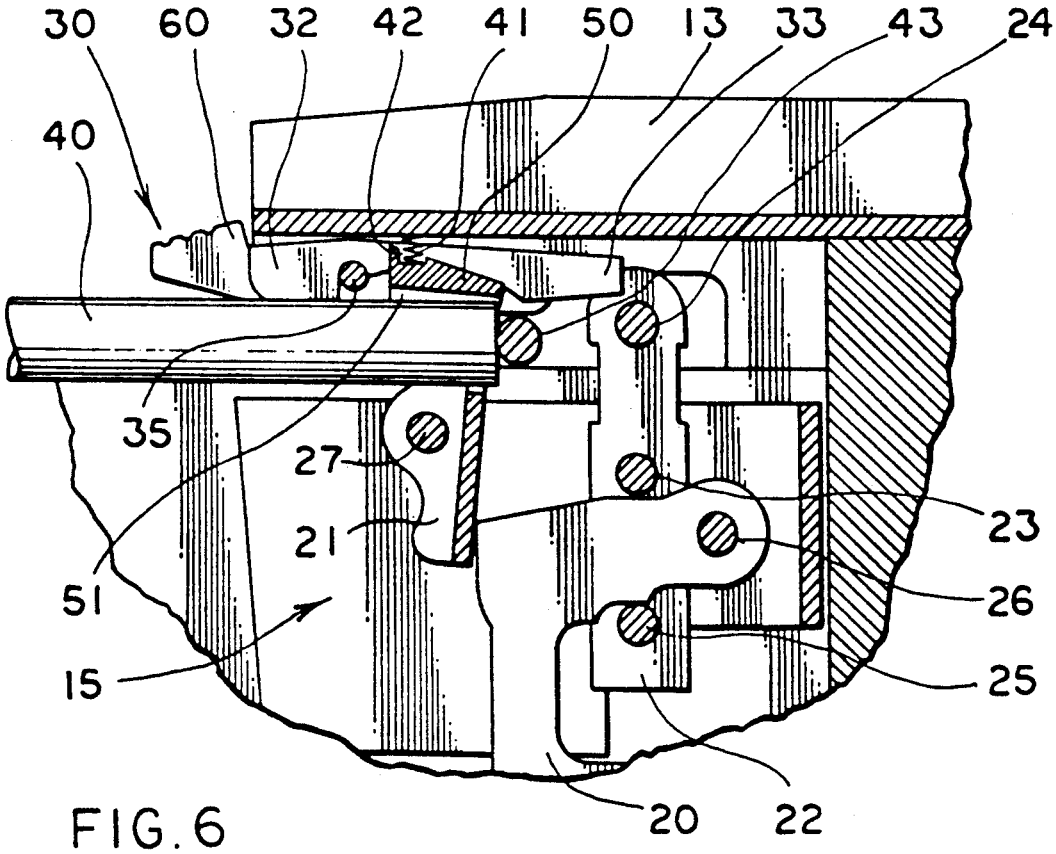
FIG. 6 is a side elevational view as in FIG. 5, showing an arrow in place and position to be fired and showing the device according to the invention in the firing position.

A trigger mechanism is generally indicated by the numeral 15 (FIGS. 5 and 6). While a complete trigger mechanism 15 is not fully depicted in the drawings, trigger mechanisms, as such, are known in the art and no single such mechanism constitutes a limitation of the invention. The present invention may be used with any such trigger mechanism as will be appreciated by one skilled in the art.

Figure 4:
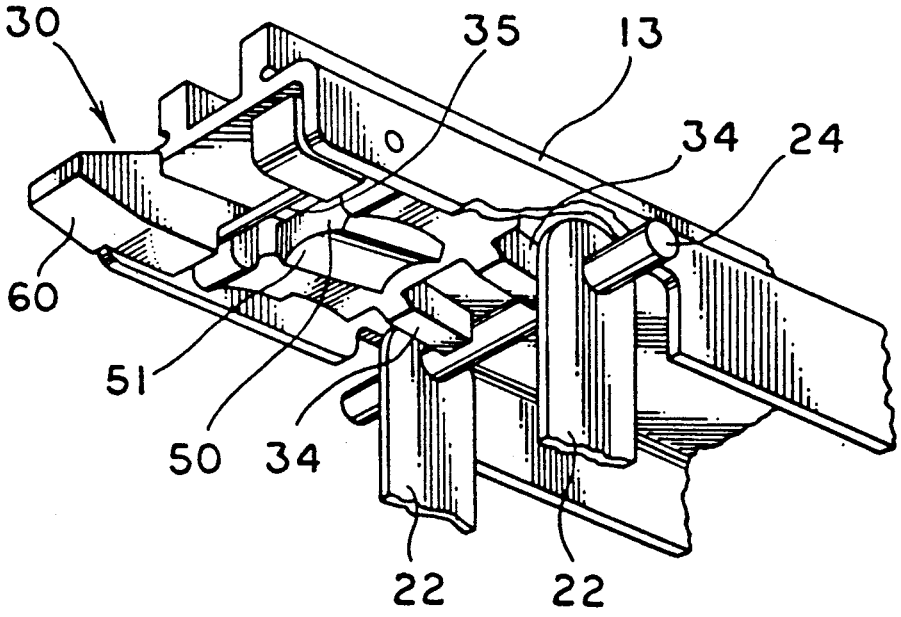
FIG. 4 is a broken away perspective view of a trigger mechanism showing the device of FIG. 2 in the dry-fire preventing position.

Trigger mechanism 15 includes a trigger 16 (FIG. 1) carried by a sear 20. Trigger mechanism 15 also includes a bowstring catch 21 and a safety assembly block plate 22. Safety assembly block plate 22 is shown as being rotatable about a pivot pin 23. To manually operate safety assembly block plate 22, it is known to provide a operating pin 24, which the user may grasp and move in a given direction to engage and disengage the safety assembly block plate 22. Furthermore, it is also known to provide a pair of safety assembly block plates 22 (FIG. 4) in order that ambidextrous manipulation is facilitated. A sear lock bolt 25 may be provided to engage and impede movement of sear 20, such as by impeding rotation about a sear pivot pin 26.

The dry-fire prevention device according to the preferred form of the present invention includes a pivotable stop block generally indicated by the numeral 30 in the drawings. As will be more fully appreciated from the discussion hereinbelow, stop block 30 operates to block or otherwise impede the movement of some portion of trigger mechanism 15 when an arrow is not in a position to be fired, thus preventing a dry-fire. It should be appreciated that the portion of trigger mechanism 15 against which stop block 30 operates to impede movement, is not necessarily a limitation of the present invention. For instance, if stop block 30 operated to impede movement of sear 20 until otherwise disengaged therefrom, a dry-fire would be effectively prevented. Furthermore, stop block 30 might also act so as to impede movement of the bowstring catch 21, such as by impeding rotation about a trigger catch pivot pin 27. Stop block 30 may also impede movement of the trigger 16 or any other portion of trigger mechanism 15. While all such embodiments are within the scope of the present invention, it is preferred that stop block 30 operate so as to impede movement of safety assembly block plate 22. Until an arrow is actually in place and in a position to be fired, stop block 30 prevents disengagement of safety assembly block plate 22. Because the user cannot disengage the safety assembly block plate 22 without an arrow in place (except by manipulating a manual override which will be discussed hereinbelow), the crossbow cannot be dry-fired.

Stop block 30 includes a body 31 having a first body section 32 and a second body section 33. Second body section 33 may be provided with one and preferably two extension members 34. Each extension member 34 extends from second body section 33 and is engageable with a portion of trigger mechanism 15, such as safety assembly block plate 22 or operating pin 24 of safety assembly block plate 22, as is depicted in the drawings. This contact between stop block 30 and trigger mechanism 15 effects locking engagement of trigger mechanism 15. Because the movement of safety assembly block plate 22 is impeded in this locking engagement, the user cannot disengage the safety assembly block plate 22 and in turn, cannot dry-fire the crossbow.

Stop block 30 is preferably pivotally mounted such that first body section 32 is separated from second body section 33 at the approximate location of the pivot point. The actual pivot point may be a pivot pin 35 locatable in a notch 36 in stop block 30 located between body section 32 and body section 33. Stop block 30 is preferably mounted in a position proximate to the rear portion of an arrow 40 when arrow 40 is in place and in position to be fired as depicted in FIG. 6. In order to facilitate this arrangement, it is preferred to mount stop block 30 in sight bridge 13 by having pivot pin 35 in turn mounted within sight bridge 13.

A bias spring, such as coil spring 41, is provided to bias stop block 30 into locking engagement with trigger mechanism 15. When an arrow is not in place, as depicted in FIG. 5, coil spring 41 biases stop block 30, and preferably extension members 34, into impeding engagement with safety assembly block plate 22, and more preferably with operating pin 24, as shown in FIG. 5. A bias spring guide, such as aperture 42, may be provided in stop block 30.

With bowstring 43 drawn and held by bowstring catch 21 as depicted in FIG. 6, as an arrow 40 is moved into position, it contacts stop block 30 and pivots it against the bias force exerted by coil spring 41 and in a direction generally away from and out of engagement with trigger mechanism 15. In the embodiment of the invention as depicted in the drawings, extension member 34 is thus caused to be disengaged from operating pin 24, allowing the user to manually disengage the safety assembly block plate 22 and fire the crossbow. Without an arrow in place, coil spring 41 biases stop block 30 back into engagement with trigger mechanism 15 thereby self-actuating the dry-fire prevention safety operation.

It is also preferred to provide stop block 30 with an arrow contacting surface 50 having a ramp portion 51. When the user places arrow 40 into a position to be fired, arrow 40 physically contacts arrow contacting surface 50 and moves stop block 30 out of locking engagement with trigger mechanism 15. If ramp portion 51 is employed, arrow 40 "rides up" or otherwise slides along ramp portion 51, gradually causing the aforesaid disengagement of stop block 30 from trigger mechanism 15.

Figure 2:
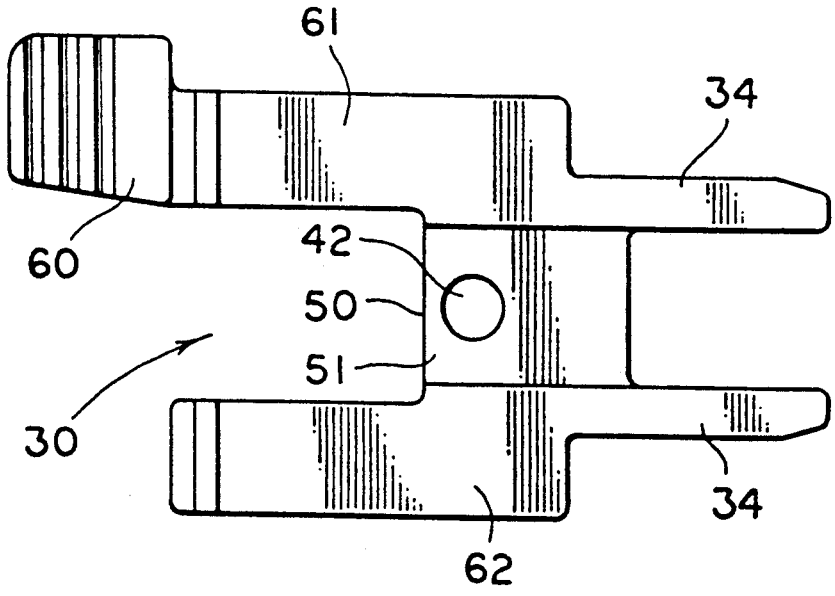
FIG. 2 is a top plan view of one embodiment or a stop block according to the present invention.
Figure 3:
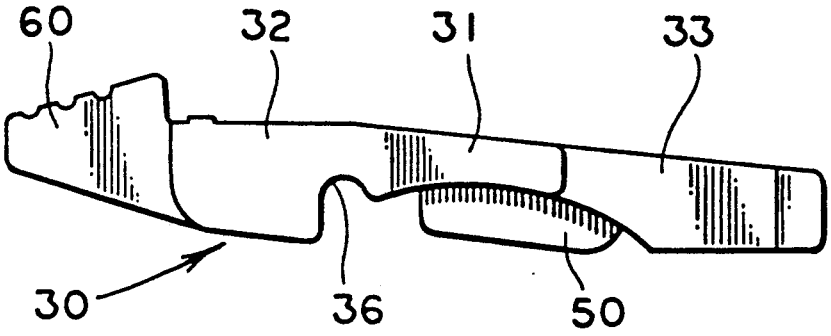
FIG. 3 is a side elevational view of the device of FIG. 2.

A manual override is also provided, and may be in the form of an override handle 60 positioned on first body section 32, which preferably extends beyond trigger mechanism housing 14. By manually depressing override handle 60, a user may cause stop block 30 to pivot about pivot pin 35 and to disengage from trigger mechanism 15. As shown in FIG. 2, first body section 32 may be bifurcated into two portions, a first portion 61 and a second portion 62, one or both of which may carry an override handle 60, although the drawings depict only first portion 61 as carrying the override handle 60.

In the embodiment of the invention in the drawings, second body section 33 includes two extension members 34, although it will be appreciated that the objects of the invention may be met without a second body section 33 or with a plurality of extension members 34, all of which are within the scope of the invention.

Furthermore, while the preferred embodiment of the invention includes a pivot pin 35 about which stop block 30 is rotatable, other means may be employed to selectively move stop block 30 into and out of locking engagement with trigger mechanism 15 other than by rotation. Thus, any suitable movement, such as by rotating, sliding, oscillating, reciprocating or the like, are all within the scope of the invention.

It should thus be evident that a self-actuating, dry-fire prevention safety device for a crossbow as disclosed herein can be employed to prevent a crossbow from firing when an arrow is not in place and in position to be fired unless manually overridden as provided. Thus the invention disclosed herein and defined by the following claims accomplishes the objects of the present invention and otherwise constitutes an advantageous contribution to the art.

We claim:

1. A self-actuating, dry-fire prevention device for a crossbow of the type having a trigger mechanism to release a bowstring to fire an arrow, the device comprising a movable stop block; means to pivot said stop block into releasable locking engagement with the trigger mechanism such that the trigger mechanism is blocked from operating to release the bowstring; said stop block having at least one arrow contacting surface such that when an arrow is placed into position to be fired, the arrow engages said arrow contacting surface causing said stop block to move out of said locking engagement with the trigger mechanism to allow operation of the trigger mechanism and release of the bowstring.

2. A self-actuating, dry-fire prevention device as in claim 1, wherein said stop block is pivotable and further comprising a pin about which said stop block is pivotable.

3. A self-actuating, dry-fire prevention device as in claim 2, wherein said means to move said stop block includes spring bias means normally biasing said stop block into said locking engagement with said trigger mechanism.

4. A self-actuating, dry-fire prevention device as in claim 3, wherein said stop block includes spring guide means for said spring bias means.

5. A self-actuating, dry-fire prevention device as in claim 1, wherein said stop block further includes at least one extension member.

6. A self-actuating, dry-fire prevention device as in claim 5, wherein said extension member is engageable with the trigger mechanism to effect said locking engagement with the trigger mechanism.

7. A self-actuating, dry-fire prevention device as in claim 6, wherein the trigger mechanism includes a trigger release safety assembly, locking engagement with the trigger mechanism being effected by engagement of said extension member with the trigger release safety assembly, wherein the trigger safety assembly is prevented from operating.

8. A self-actuating, dry-fire prevention device as in claim 1, wherein said arrow contacting surface is a ramp.

9. A self-actuating, dry-fire prevention device as in claim 1, further comprising override means for manually disengaging said stop block from said locking engagement with the trigger mechanism.

10. A device for preventing an inadvertent activation of a trigger mechanism of a crossbow without an arrow in place comprising a stop block; said stop block including a body member to engage a portion of the trigger mechanism; said body member including an arrow contacting surface which when engaged by the arrow upon placement of the arrow into position to be fired will move said body member out of engagement with the trigger mechanism.

11. A device as in claim 10, further comprising a pivot member, said stop block being pivotable about pivot member.

12. A device as in claim 11, wherein said pivot member includes a pivot bar.

13. A device as in claim 12, wherein said body member includes a first body portion on one side of said pivot member and a second body portion on the other side of said pivot member, said second body section including at least one extension member.

14. A device as in claim 13, further comprising spring bias means normally biasing said second body portion about said pivot member.

15. A device as in claim 14, further comprising spring guide means carried by said body member.

16. A device as in claim 15, wherein said first body portion includes a manual override element extending therefrom, to overcome the bias force of said spring bias means.

17. A device as in claim 10, wherein said arrow contacting surface includes a ramp portion.

18. A crossbow having a bowstring comprising a trigger mechanism operable to selectively hold and release the bowstring, a pivotable stop block; and means to pivot said stop block into releasable locking engagement with said trigger mechanism such that said trigger mechanism is blocked from operating to release the bowstring; said stop block having at least one arrow contacting surface such that when an arrow is placed into position to be fired, the arrow engages said arrow contacting surface causing said stop block to pivot out of said locking engagement with said trigger mechanism to allow operation of the trigger mechanism and release of the bowstring.

19. A crossbow as in claim 18, further comprising a pin about which said stop block is rotatable.

20. A crossbow as in claim 19, wherein said means to pivot said stop block includes spring bias means normally biasing said stop block into said locking engagement with said trigger mechanism.

21. A crossbow as in claim 20, wherein said stop block includes spring guide means for said spring bias means.

22. A crossbow as in claim 21, wherein said stop block further includes at least one extension member engageable with said trigger mechanism to effect said locking engagement with said trigger mechanism.

23. A crossbow as in claim 22, wherein said trigger mechanism includes a trigger release safety assembly and locking engagement with said trigger mechanism being effected by engagement of said extension member with said trigger release safety assembly, wherein said trigger release safety assembly is prevented from operating.

24. A crossbow as in claim 18, wherein said arrow contacting surface is a ramp.

25. A crossbow as in claim 18, further comprising override means for manually disengaging said pivotable stop block from said locking engagement with said trigger mechanism.

* * * * *